US008683729B2

(12) United States Patent
Bova

(10) Patent No.: US 8,683,729 B2
(45) Date of Patent: Apr. 1, 2014

(54) AMBIDEXTROUS THUMB SAFETY ASSEMBLY

(75) Inventor: Chris Bova, Barrington, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 13/453,395

(22) Filed: Apr. 23, 2012

(65) Prior Publication Data

US 2012/0291326 A1 Nov. 22, 2012

Related U.S. Application Data

(60) Provisional application No. 61/478,259, filed on Apr. 22, 2011.

(51) Int. Cl.
*F41A 17/74* (2006.01)

(52) U.S. Cl.
USPC ..... 42/70.08; 42/70.01; 89/148

(58) Field of Classification Search
USPC ..... 42/70.06, 70.01, 70.04, 70.05, 70.08, 42/70.11; 89/148, 150
See application file for complete search history.

(56) References Cited

U.S. PATENT DOCUMENTS

| | | | | | |
|---|---|---|---|---|---|
| 3,492,748 | A * | 2/1970 | Swenson | 42/70.01 |
| 4,282,795 | A * | 8/1981 | Beretta | 89/148 |
| 4,414,769 | A * | 11/1983 | Mueschke | 42/70.01 |
| 5,903,994 | A * | 5/1999 | Tange | 42/70.01 |
| 8,276,502 | B1 * | 10/2012 | Wright | 89/148 |
| 2002/0020100 | A1 * | 2/2002 | Roca et al. | 42/70.11 |
| 2005/0229462 | A1 * | 10/2005 | McGarry | 42/70.08 |
| 2010/0024274 | A1 * | 2/2010 | Lippard | 42/70.05 |

* cited by examiner

*Primary Examiner* — Samir Abdosh
*Assistant Examiner* — John D Cooper
(74) *Attorney, Agent, or Firm* — Finch & Maloney PLLC

(57) ABSTRACT

An ambidextrous thumb safety assembly, configured for use in a firearm, includes a first lever assembly for positioning on a first side of the firearm, a second lever assembly for positioning on a second side of the firearm, and a monolithic shaft assembly for coupling the first lever assembly and the second lever assembly. The monolithic shaft assembly includes a first support portion configured to rotatably engage a first portion of a frame of the firearm, a second support portion configured to rotatably engage a second portion of the frame of the firearm, and a control portion configured to selectively prohibit operation of a trigger mechanism of the firearm.

23 Claims, 12 Drawing Sheets

(Section AA of FIG. 10)

(Section BB of FIG. 10)

AMBIDEXTROUS THUMB SAFETY ASSEMBLY

CROSS-REFERENCE TO RELATED APPLICATION

This application claims the benefit of U.S. Provisional Patent Application Ser. No. 61/478,259, filed 22 Apr. 2011, the entire contents of which are incorporated herein by reference.

TECHNICAL FIELD

This disclosure relates to firearm safety assemblies and, more particularly to ambidextrous thumb safety assemblies for use within firearms.

BACKGROUND

Firearms often employ various safety devices to prevent the inadvertent and unexpected discharge of the firearm. For example, firearms typically employ passive trigger safeties that prevent the firearm from discharging due to inertia on the trigger in the event that e.g., the firearm is dropped.

Additionally, more active safeties (e.g., thumb safeties) may be utilized that require the user to disengage the safety prior to discharging the firearm. Unfortunately, such thumb safeties are often not ambidextrous and may not be properly supported within the frame of the firearm.

SUMMARY OF DISCLOSURE

In a first implementation, an ambidextrous thumb safety assembly, configured for use in a firearm, includes a first lever assembly for positioning on a first side of the firearm, a second lever assembly for positioning on a second side of the firearm, and a monolithic shaft assembly for coupling the first lever assembly and the second lever assembly. The monolithic shaft assembly includes a first support portion configured to rotatably engage a first portion of a frame of the firearm, a second support portion configured to rotatably engage a second portion of the frame of the firearm, and a control portion configured to selectively prohibit operation of a trigger mechanism of the firearm.

One or more of the following features may be included. The monolithic shaft assembly may be a portion of one of the first and second lever assemblies. The monolithic shaft assembly may be configured to releasably engage one of the first and second lever assemblies. The monolithic shaft assembly may include a protrusion. At least one of the first and second lever assemblies may include a recess configured to receive the protrusion. The protrusion may be a bowtie-shaped protrusion and the recess may be a bowtie-shaped recess configured to receive the bowtie-shaped protrusion.

The first and second support portions may be positioned on opposite sides of the control portion. The trigger mechanism of the firearm may include a hammer assembly and the control portion of the monolithic shaft assembly may be configured to selectively prohibit operation of the hammer assembly. The control portion of the monolithic shaft assembly may be configured to selectively lock the hammer assembly in a cocked position. The control portion of the monolithic shaft assembly may be configured to selectively lock the hammer assembly in an uncocked position.

The trigger mechanism of the firearm may include a linkage assembly for coupling a trigger assembly to the hammer assembly included within the firearm. The linkage assembly may include a trigger bar and a sear assembly. The control portion of the monolithic shaft assembly may be configured to selectively prohibit operation of the sear assembly. The firearm may be a handgun.

In another implementation, a firearm includes a trigger mechanism including a hammer assembly, and a linkage assembly for coupling a trigger assembly to the hammer assembly. An ambidextrous thumb safety assembly includes a first lever assembly for positioning on a first side of the firearm, a second lever assembly for positioning on a second side of the firearm, and a monolithic shaft assembly for coupling the first lever assembly and the second lever assembly. The monolithic shaft assembly includes a first support portion configured to rotatably engage a first portion of a frame of the firearm, a second support portion configured to rotatably engage a second portion of the frame of the firearm, and a control portion configured to selectively prohibit operation of the trigger mechanism of the firearm.

One or more of the following features may be included. The monolithic shaft assembly may be a portion of one of the first and second lever assemblies. The control portion of the monolithic shaft assembly may be configured to selectively prohibit operation of the hammer assembly. The control portion of the monolithic shaft assembly may be configured to selectively lock the hammer assembly in a cocked position. The control portion of the monolithic shaft assembly may be configured to selectively lock the hammer assembly in an uncocked position.

In another implementation, an ambidextrous thumb safety assembly, configured for use in a firearm, includes a first lever assembly for positioning on a first side of the firearm, a second lever assembly for positioning on a second side of the firearm, and a monolithic shaft assembly for coupling the first lever assembly and the second lever assembly. The monolithic shaft assembly includes a first support portion configured to rotatably engage a first portion of a frame of the firearm, a second support portion configured to rotatably engage a second portion of the frame of the firearm, and a control portion configured to selectively prohibit operation of a hammer assembly of the firearm.

One or more of the following features may be included. The monolithic shaft assembly may be a portion of one of the first and second lever assemblies. The trigger mechanism of the firearm may include a hammer assembly and the control portion of the monolithic shaft assembly may be configured to selectively prohibit operation of the hammer assembly. The control portion of the monolithic shaft assembly may be configured to selectively lock the hammer assembly in a cocked position. The control portion of the monolithic shaft assembly may be configured to selectively lock the hammer assembly in an uncocked position.

The details of one or more implementations are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION OF THE PREFERRED EMBODIMENTS

Figure 1:
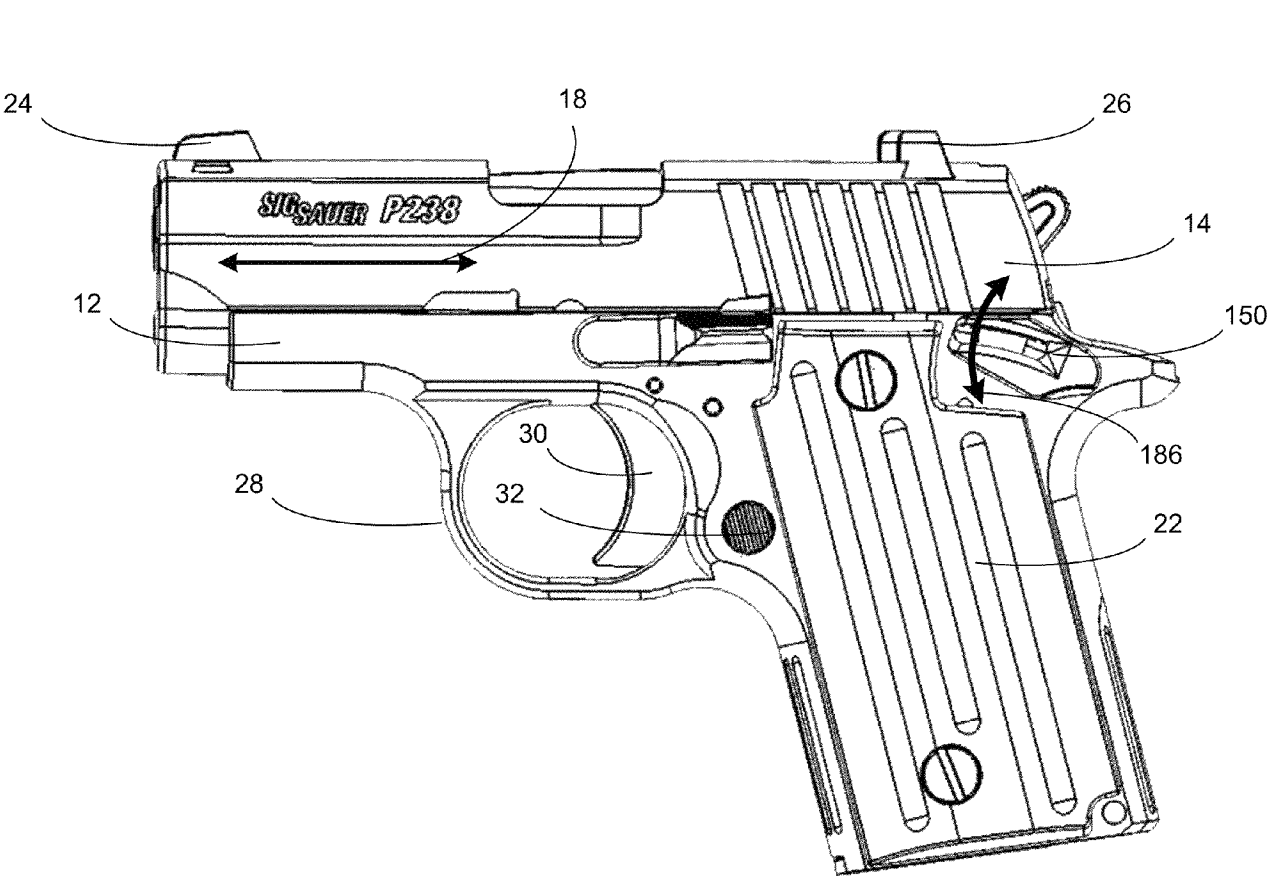
FIG. 1 is a diagrammatic view of a firearm including an ambidextrous thumb safety assembly.
Figure 2:
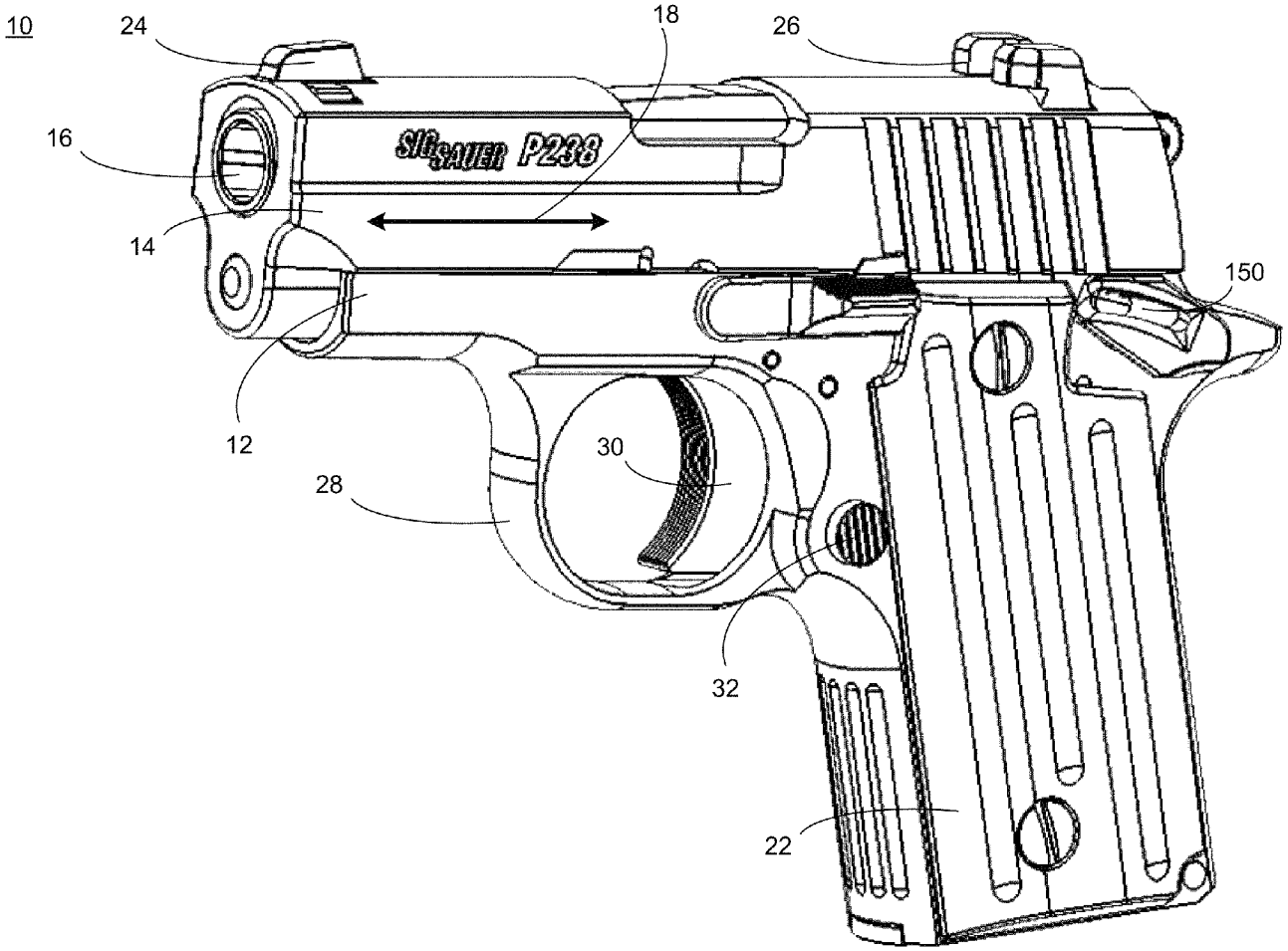
FIG. 2 is another diagrammatic view of the firearm of FIG. 1 including the ambidextrous thumb safety assembly.
Figure 3:
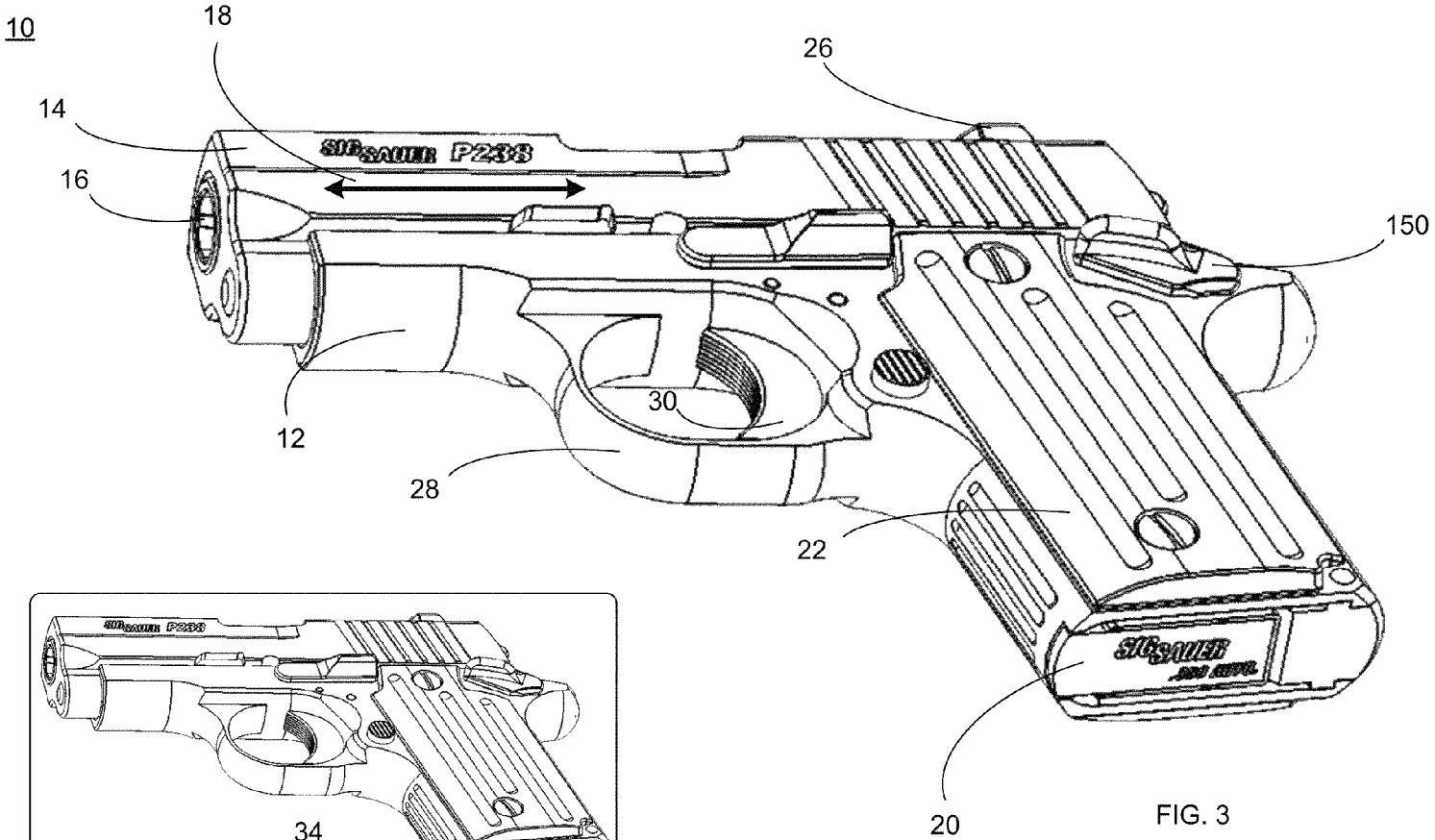
FIG. 3 is another diagrammatic view of the firearm of FIG. 1 including the ambidextrous thumb safety assembly.

Referring to FIGS. 1-3, there is shown firearm 10. Examples of firearm 10 may include but are not limited to a semiautomatic handgun. However, the subject disclosure may be applicable to any firearm.

Figure 3A:
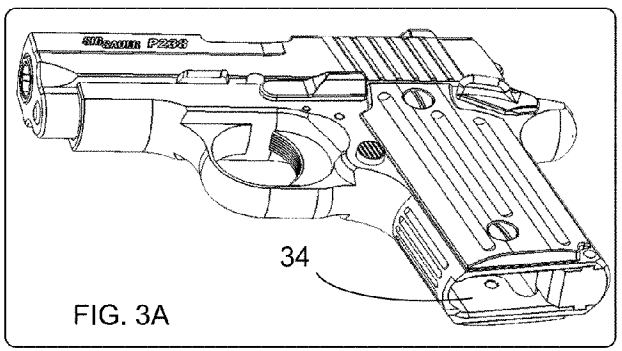
FIG. 3A is another diagrammatic view of the firearm of FIG. 1 with the ammunition magazine assembly removed.

Firearm 10 may include frame assembly 12 and slide assembly 14, which may surround barrel assembly 16 and cycle in the direction of arrow 18 to load ammunition from ammunition magazine assembly 20 into the chamber (not shown) of firearm 10. Firearm 10 may include grip assembly 22, which may be configured to receive ammunition magazine assembly 20. Firearm 10 may further include front sight assembly 24 and rear sight assembly 26 to aid in aiming firearm 10. Firearm 10 may further include trigger guard 28 that may be configured to shield trigger assembly 30, thus preventing the accidental displacement of trigger assembly 30. Magazine release assembly 32 may be included within firearm 10 to allow for the removal of ammunition magazine assembly 20 from magazine well 34 (as shown in FIG. 3A).

Figure 4:
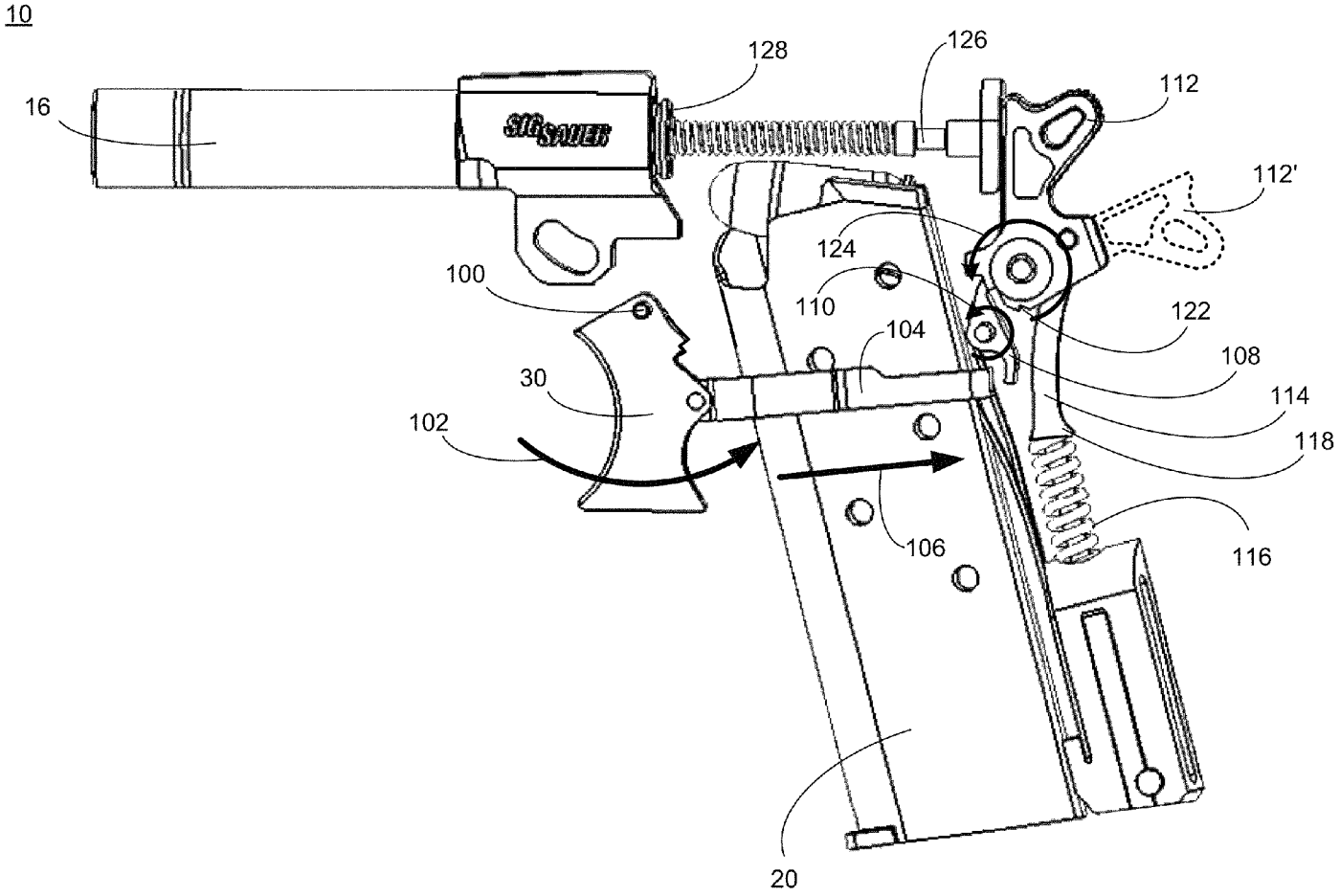
FIG. 4 is a detail view of the firearm of FIG. 1.
Figure 5:
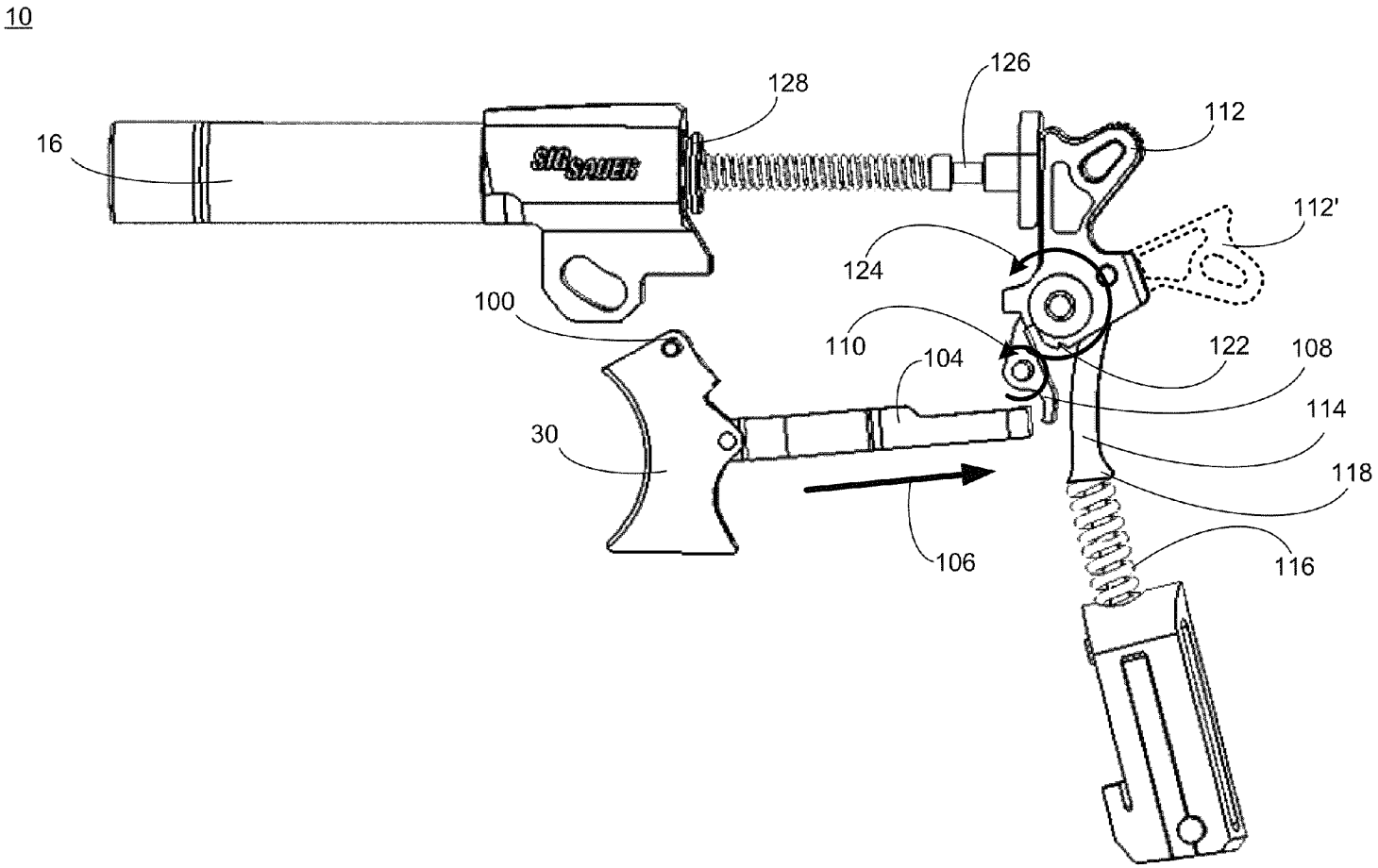
FIG. 5 is another detail view of the firearm of FIG. 1.
Figure 6:
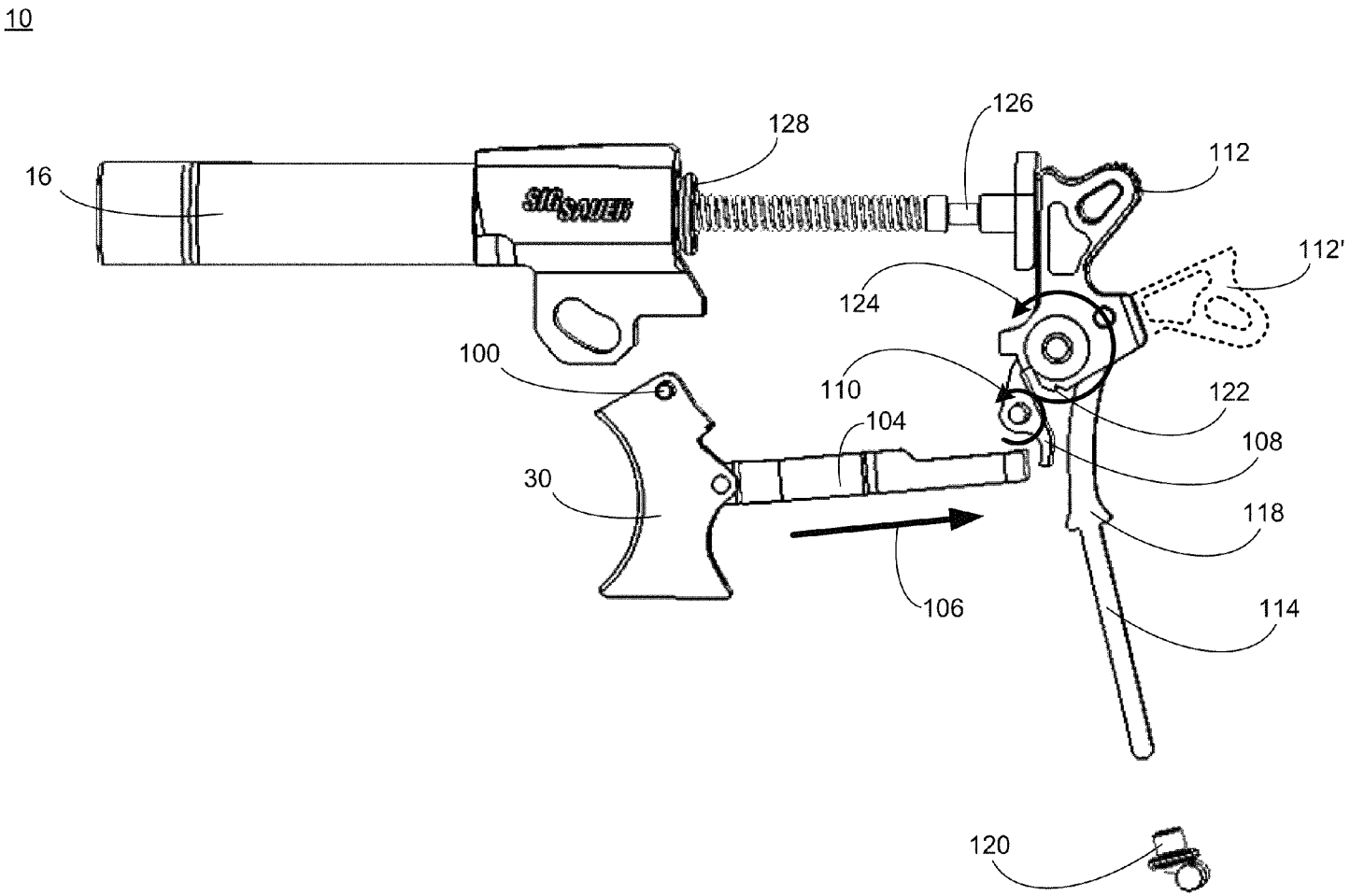
FIG. 6 is another detail view of the firearm of FIG. 1.

Referring to FIGS. 4-6, there is shown a detail view of firearm 10 with various components of firearm 10 removed (e.g. frame assembly 12 and slide assembly 14, as shown in FIGS. 1-3) to allow for viewing of the various internal components of firearm 10. Trigger assembly 30 may be configured to pivot about pivot point 100 to allow for trigger assembly 30 to be displaced in a counterclockwise fashion (in the direction of arrow 102) as a user (not shown) depresses trigger assembly 30. Alternatively, a non-pivoting trigger assembly (not shown) may be utilized within firearm 10.

As trigger assembly 30 rotates in a counterclockwise fashion, trigger bar 104 may be displaced longitudinally (in the direction of arrow 106), which displaces sear assembly 108 in a counterclockwise fashion (in the direction of arrow 110), thus disengaging sear assembly 108 from hammer assembly 112.

Hammer assembly 112 may be biased into the uncocked position (as shown in FIGS. 4-6) via the combination of strut rod 114 and hammer spring 116 (which is held captive between strut rod flange 118 and spring retainer 120). When hammer assembly 112 is placed into the cocked position, sear assembly 108 may hold hammer assembly 112 in the cocked position (as illustrated via cocked hammer assembly 112') by releasably engaging notch 122 of hammer assembly 112. Accordingly, when sear assembly 108 is displaced (in the direction of arrow 110), sear assembly 108 may disengage notch 122, resulting in hammer assembly 112 rotating in a counterclockwise fashion (in the direction of arrow 124 due to the bias of hammer spring 116) from the cocked position (as illustrated via cocked hammer assembly 112') to the uncocked position (as illustrated via hammer assembly 112), which may result in hammer assembly 112 striking firing pin 126 that may impact cartridge 128 and discharge firearm 10.

Firearm 10 may include ambidextrous thumb safety assembly 150 that may be configured to prohibit the operation of the trigger mechanism of firearm 10 (thus selectively prohibiting firearm 10 from discharging). For example and as will be discussed below, ambidextrous thumb safety assembly 150 may be configured to selectively prohibit operation of hammer assembly 112. Additionally/alternatively, ambidextrous thumb safety assembly 150 may be configured to selectively prohibit operation of sear assembly 108.

Referring also to FIGS. 7A-7D, 8A-8B, 9A-9D & 10-12, there are shown various detail views of ambidextrous thumb safety assembly 150. Ambidextrous thumb safety assembly 150 may include first lever assembly 152 configured to be positioned on a first side (e.g., the left side) of firearm 10. Second lever assembly 154 may be configured to be positioned on a second side (e.g., the right side) of firearm 10. Monolithic shaft assembly 156 may be configured to couple first lever assembly 152 and second lever assembly 154.

Monolithic shaft assembly 156 may include first support portion 158 configured to rotatably engage a first portion (e.g., portion 160) of frame assembly 12 of firearm 10. Second support portion 162 of monolithic shaft assembly 156 may be configured to rotatably engage second portion 164 of frame assembly 12 of firearm 10. Control portion 166 of monolithic shaft assembly 156 may be configured to selectively prohibit operation of the trigger mechanism of firearm 10. First and second support portions 158, 162 may be positioned on opposite sides of control portion 166, thus providing a high level of stability when monolithic shaft assembly 156 is positioned within frame assembly 12.

As monolithic shaft assembly 156 is a one-piece design that rotatably contacts portion 160 and portion 164 of frame assembly 12 (via first support portion 158 and second support portion 162, respectively), monolithic shaft assembly 156 (and, therefore, ambidextrous thumb safety assembly 150) may be securely positioned within frame assembly 12 with minimum wobble, looseness and/or deflection.

Figure 9C:
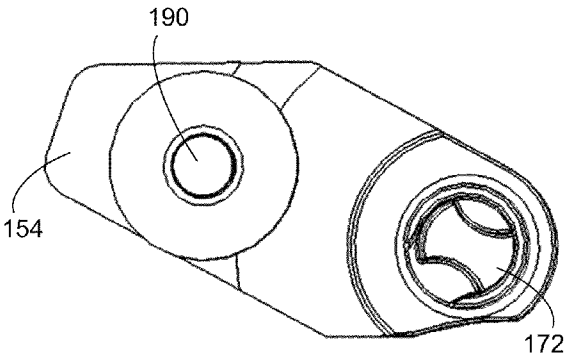
FIGS. 9A-9D are detail views of the ambidextrous thumb safety assembly of the firearm of FIG. 1.
Figure 9D:
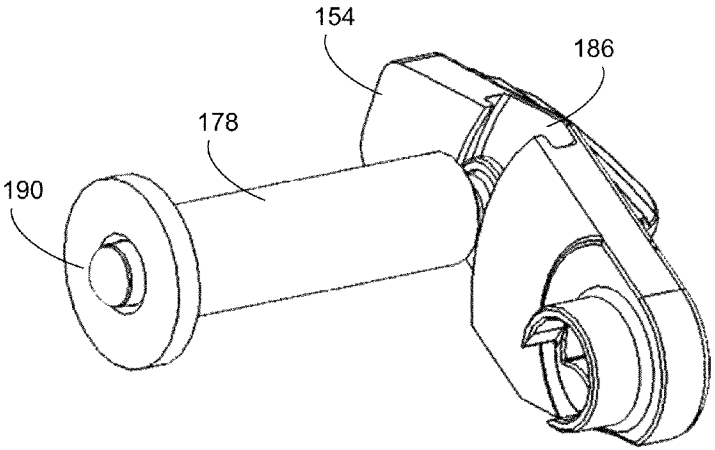
Figure 9A:
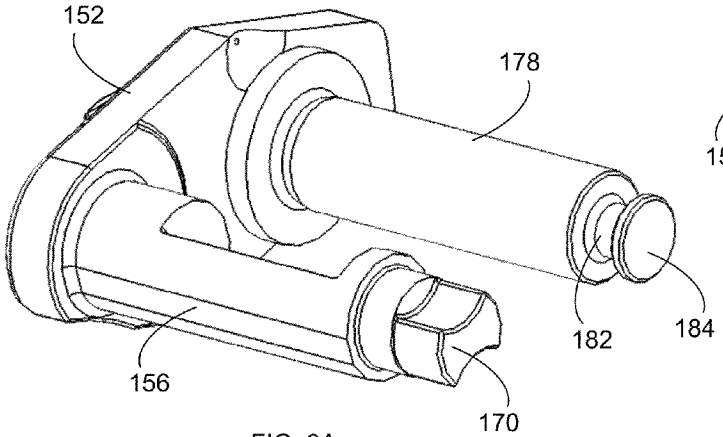
Figure 9B:
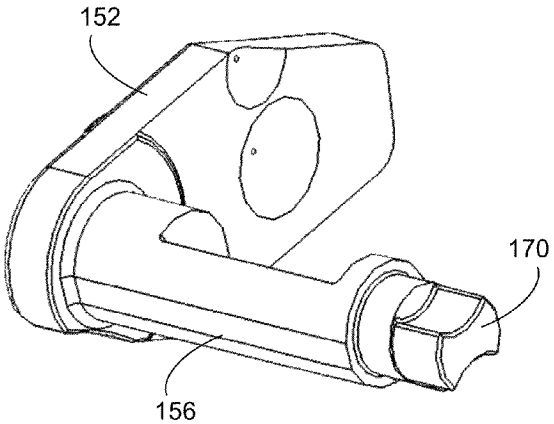
Figure 10:
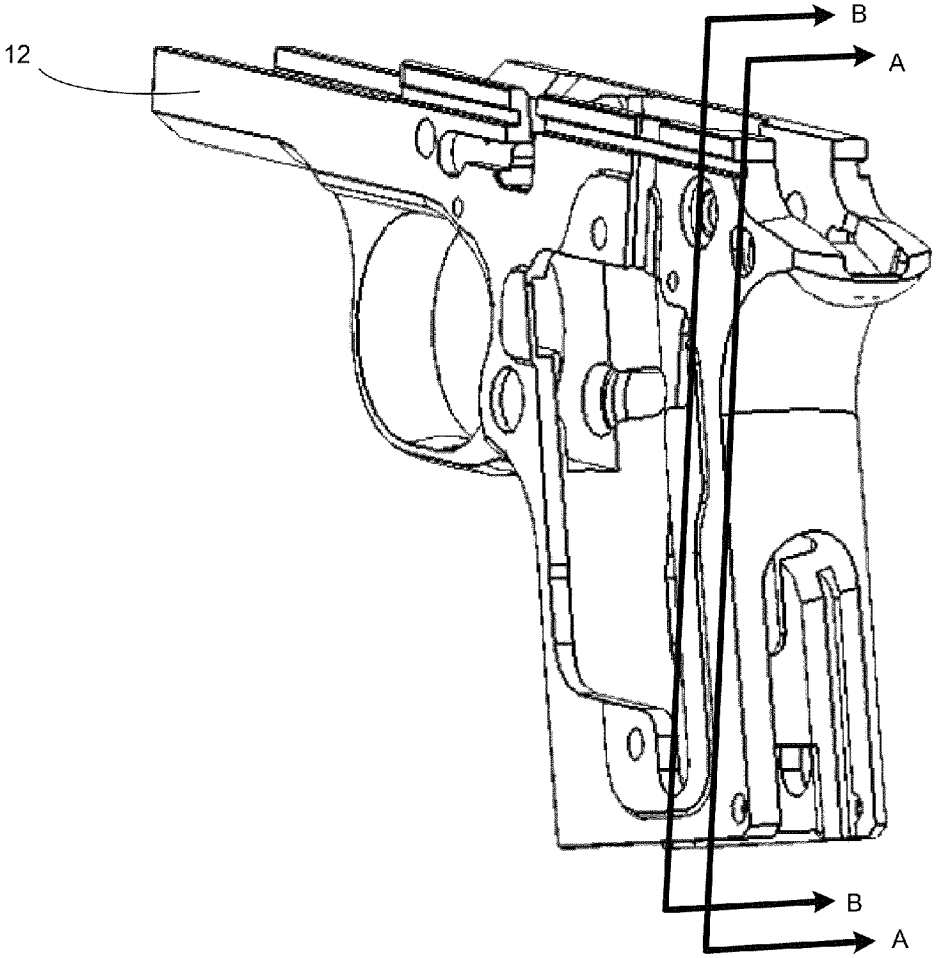
FIG. 10 is a diagrammatic view of the frame of the firearm of FIG. 1.
Figure 11:
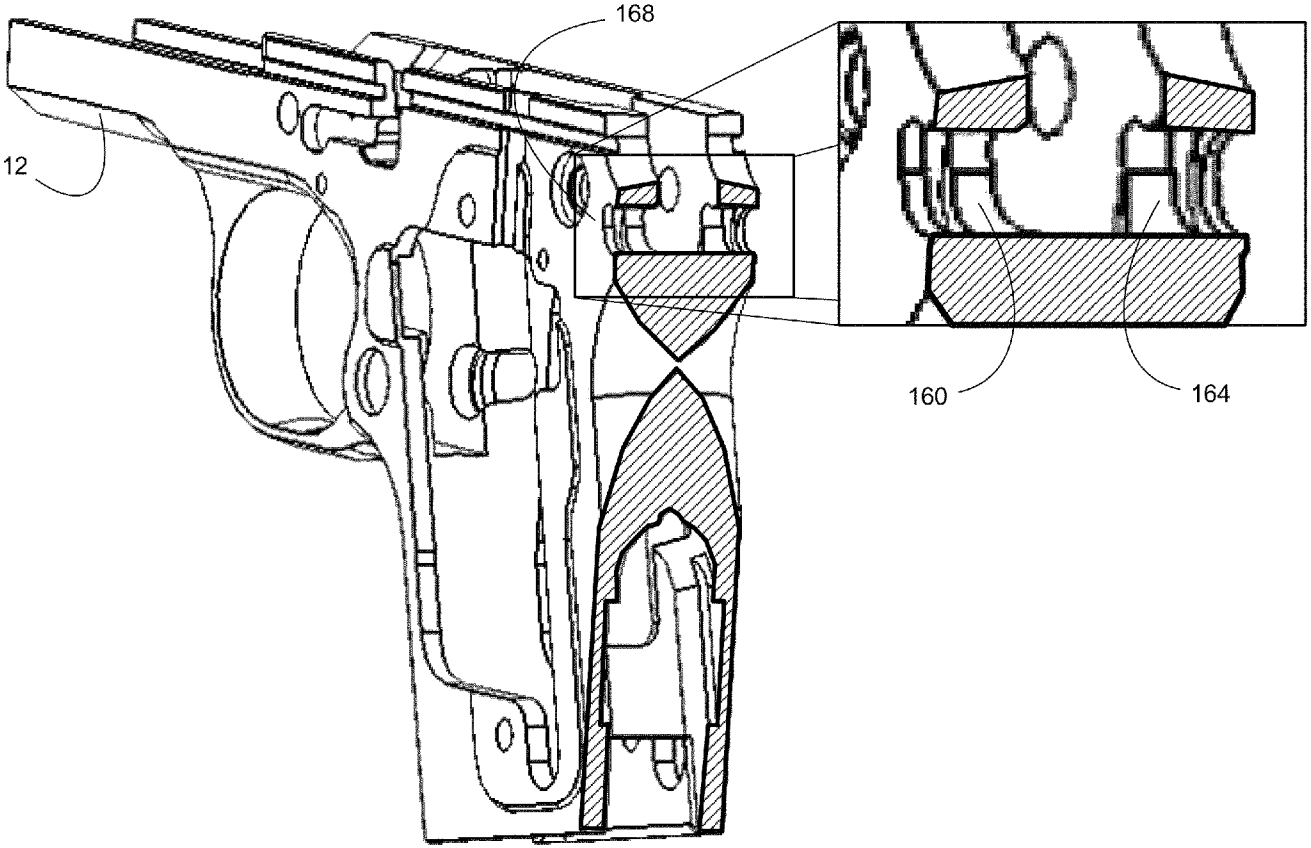
FIG. 11 is a first cross-sectional view of the frame of the firearm of FIG. 1.
Figure 12:
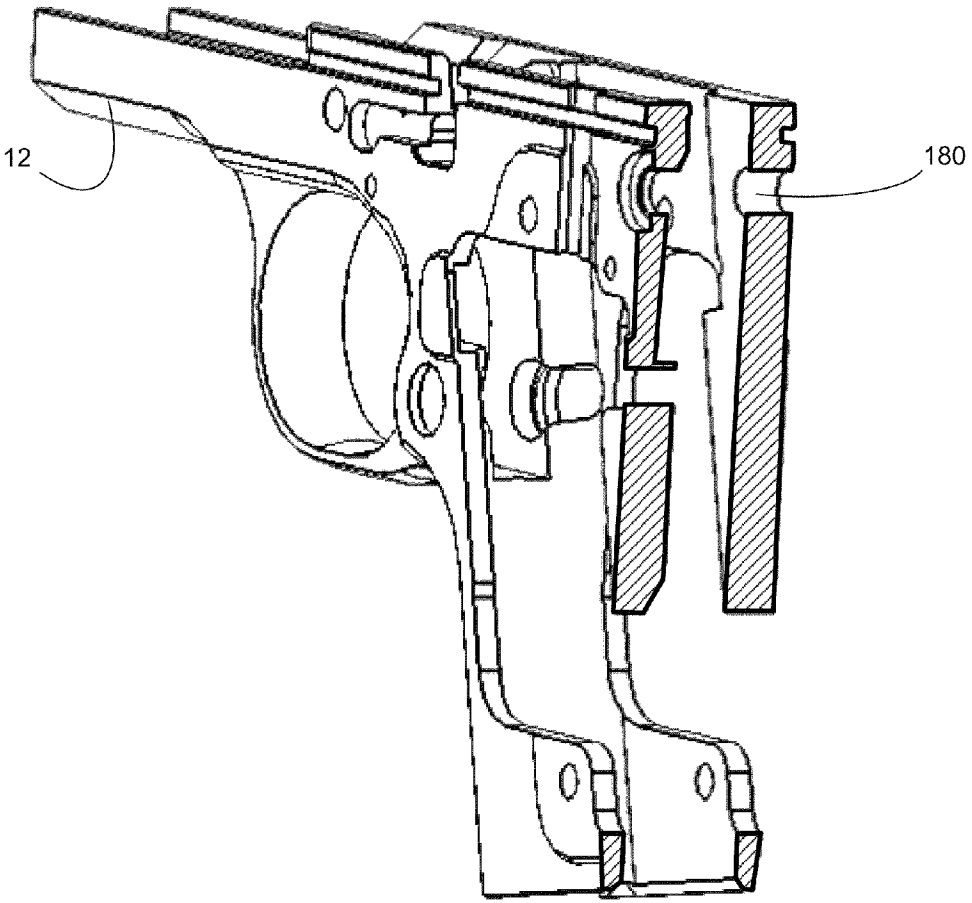
FIG. 12 is a second cross-sectional view of the frame of the firearm of FIG. 1.

Monolithic shaft assembly 156 may be a portion of one of first lever assembly 152 or second lever assembly 156. For example and as shown in FIGS. 9A-9B, monolithic shaft assembly 156 is shown to be a portion of/permanently affixed to first lever assembly 152. Accordingly, first lever assembly 152 and monolithic shaft assembly 156 may be machined from a single piece of material (e.g., steel).

Monolithic shaft assembly 156 may be configured to releasably engage one of first and second lever assemblies 152, 154. For example, when installing ambidextrous thumb safety assembly 150 into firearm 10, the combination of first lever assembly 152 and monolithic shaft assembly 156 (as shown in FIGS. 9A-9B) may be inserted into passage 168 from the left side of frame assembly 12 so that a portion of monolithic shaft assembly 156 extends through the right side of frame assembly 12, such that second lever assembly 154 may releasably engages the portion of monolithic shaft assembly 156 extending from frame assembly 12.

For example, monolithic shaft assembly 156 may include protrusion 170, wherein at least one of first and second lever assemblies 152, 154 includes recess 172 configured to receive protrusion 170. Protrusion 170 may be in the form of a bowtie-shaped protrusion and recess 172 may be in the form of a bowtie-shaped recess that is configured to receive the bowtie-shaped protrusion. Specifically, an interference fit may be established between protrusion 170 and recess 172 wherein recess 172 may be e.g., one or more thousandths of an inch smaller than protrusion 170. Accordingly, when protrusion 170 is pressed into recess 172, an interference fit may be achieved.

The trigger mechanism of firearm 10 may include hammer assembly 112 and a linkage assembly (e.g., trigger bar 104 and sear assembly 108) for coupling trigger assembly 30 to hammer assembly 112. As stated above, control portion 166 of monolithic shaft assembly 156 may be configured to selectively prohibit operation of hammer assembly 112. For example, control portion 166 of monolithic shaft assembly 156 may be configured to selectively lock hammer assembly 112 in a cocked position (as illustrated via cocked hammer assembly 112') and/or may be configured to selectively lock hammer assembly 112 in an uncocked position (as illustrated via hammer assembly 112).

Figure 7C:
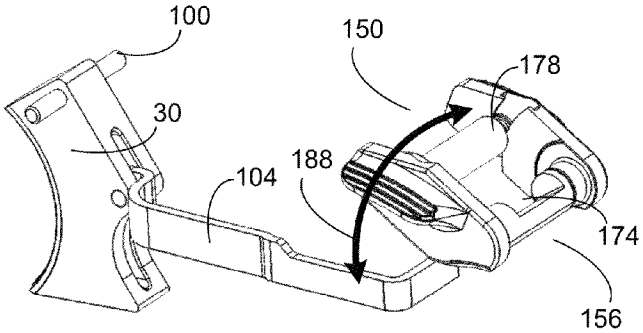
FIGS. 7C-7D are detail views of the ambidextrous thumb safety assembly of the firearm of FIG. 1.
Figure 7D:
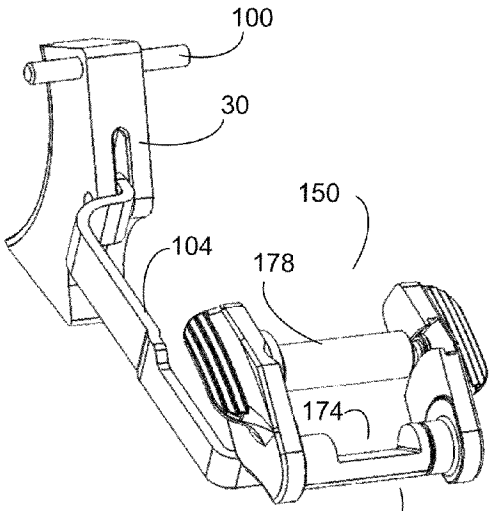
Figure 7A:
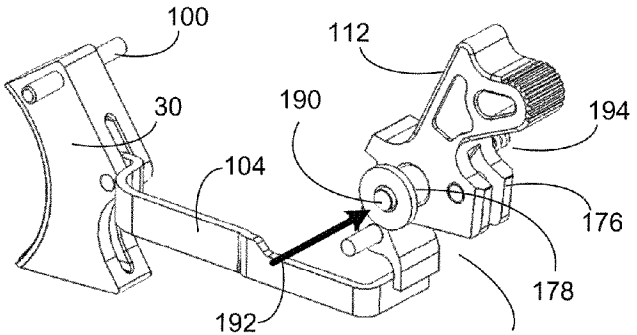
FIGS. 7A-7B are detail views of the hammer assembly of the firearm of FIG. 1.
Figure 7B:
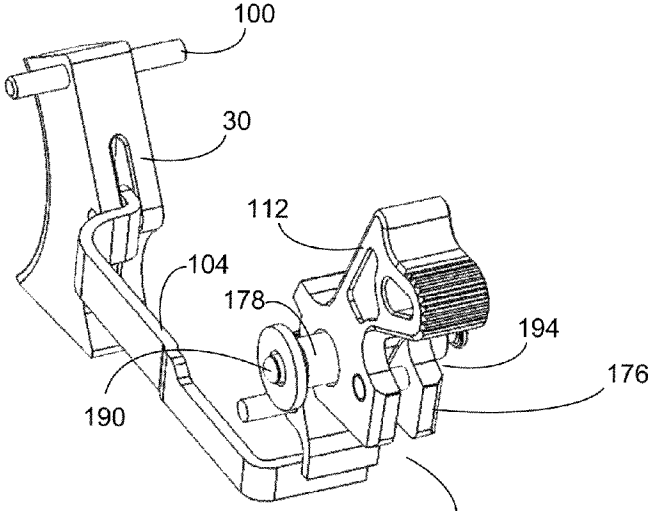
Figures 8A, 8B:
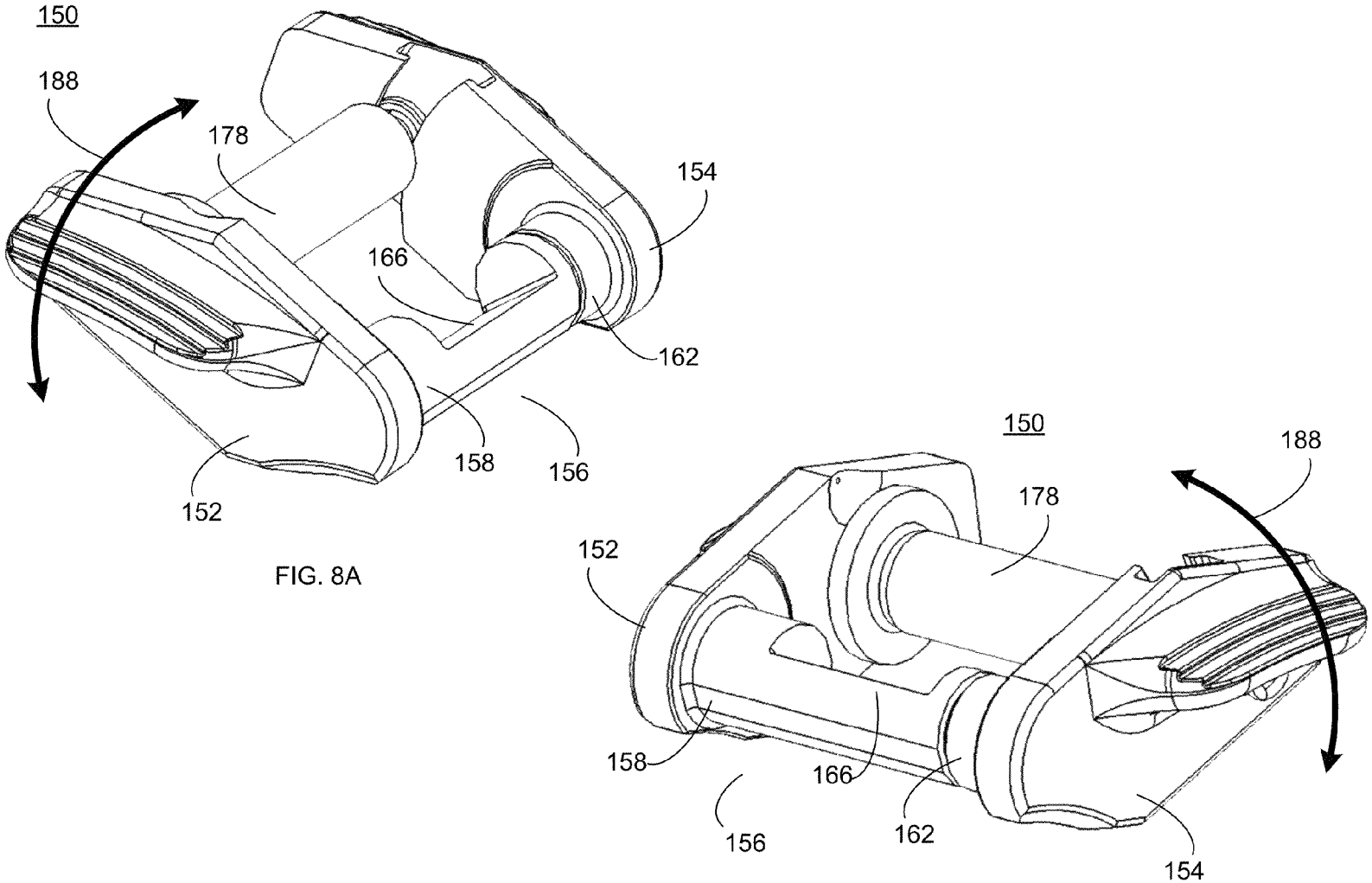
FIGS. 8A-8B are detail views of the ambidextrous thumb safety assembly of the firearm of FIG. 1.

Referring again to FIGS. 7A-7D, control surface 166 of monolithic shaft assembly 156 may include trough 174 cut through monolithic shaft assembly 156 that provides clearance through which hammer protrusion 176 may pass when ambidextrous thumb safety assembly 150 is disengaged. Specifically, FIGS. 7A-7B show various portions of the trigger mechanism of firearm 10 with ambidextrous thumb safety assembly 150 removed (for clarity). Further, FIGS. 7C-7D show various portions of the trigger mechanism of firearm 10 with hammer assembly 112 removed (for clarity). As is shown within FIGS. 7A-7D, hammer assembly 112 rotates about pin assembly 178 and ambidextrous thumb safety assembly 150 rotates about monolithic shaft assembly 156. Pin assembly 178 may pass through passage 180 included within frame assembly 12.

Referring also again to FIGS. 8A-8B, 9A-9D & 10-12, pin assembly 178 may include circumferential groove 182 that may form disk assembly 184 that may be configured to slide within slot 186 included within second lever assembly 154 of ambidextrous thumb safety assembly 150. Accordingly, even though pin assembly 178 is rigidly positioned within frame assembly 12 of firearm 10, the combination of slot 186 (included within second lever assembly 154) and disk assembly 184 may allow ambidextrous thumb safety assembly 150 to be cycled (in the direction of arrow 188) between engaged (i.e., upward position) and disengaged (i.e., downward position).

Pin assembly 178 may further include spring-loaded ball assembly 190 that may be biased (via a spring assembly, not shown) so that a portion of spring-load ball assembly 190 protrudes from the end of pin assembly 178, wherein spring-loaded ball assembly 190 may be displaced into pin assembly 178 by providing inward pressure (in the direction of arrow 192) that exceeds the outward pressure provided by the spring assembly (not shown).

As discussed above, control portion 166 of monolithic shaft assembly 156 may be configured to selectively lock hammer assembly 112 in a cocked position (as illustrated via cocked hammer assembly 112') and/or may be configured to selectively lock hammer assembly 112 in an uncocked position (as illustrated via hammer assembly 112).

Accordingly, in the event that ambidextrous thumb safety assembly 150 is to be used to lock hammer assembly 112 in a cocked position (as illustrated via cocked hammer assembly 112'), hammer assembly 112 may first be cocked (i.e., placed into the position shown by cocked hammer assembly 112'), thus positioning monolithic shaft assembly 156 within gap 194 above hammer protrusion 176. Ambidextrous thumb safety assembly 150 may then be engaged (i.e. cycled upward), thus rotating monolithic shaft assembly 156 and misaligning trough 174 (with respect to hammer protrusion 176). Accordingly, the operation of hammer assembly 112 will be prohibited, as hammer protrusion 176 will no longer be able to pass through trough 174 (thus preventing the discharging of firearm 10).

Further, in the event that ambidextrous thumb safety assembly 150 is to be used to lock hammer assembly 112 in an uncocked position (as illustrated via hammer assembly 112), with hammer assembly 112 in the uncocked position, monolithic shaft assembly 156 may be positioned within gap 196 below hammer protrusion 176. Ambidextrous thumb safety assembly 150 may then be engaged (i.e. cycled upward), thus rotating monolithic shaft assembly 156 and misaligning trough 174 (with respect to hammer protrusion 176. Accordingly, the operation of hammer assembly 112 will be prohibited, as hammer protrusion 176 will no longer be able to pass through trough 174 (thus preventing the cocking of hammer assembly 112 and, therefore, the discharging of firearm 10).

While ambidextrous thumb safety assembly 150 is described above as prohibiting the operation of hammer assembly 112, this is for illustrative purposes only and is not intended to be a limitation of this disclosure. For example, control portion 166 of monolithic shaft assembly 156 may be configured to selectively prohibit operation of sear assembly 108. Accordingly, ambidextrous thumb safety assembly 150 may be configured and positioned so that upon ambidextrous thumb safety system 150 being engaged, control portion 166 of monolithic shaft 156 engages sear assembly 108 and prevent sear assembly 108 from disengaging hammer assembly 112 (thus preventing the discharging of firearm 10).

Having thus described the disclosure of the present application in detail and by reference to embodiments thereof, it will be apparent that modifications and variations are possible without departing from the scope of the disclosure defined in the appended claims.

What is claimed is:

1. An ambidextrous thumb safety assembly configured for use in a firearm comprising:

a first lever assembly for positioning on a first side of the firearm;

a second lever assembly for positioning on a second side of the firearm; and a monolithic shaft assembly for coupling the first lever assembly and the second lever assembly, the monolithic shaft assembly including:

a first support portion configured to rotatably engage a first portion of a frame of the firearm, a second support portion configured to rotatably engage a second portion of the frame of the firearm a control portion configured to selectively prohibit operation of a trigger mechanism of the firearm, wherein the first support portion and the second support portion are positioned on opposite sides of the control portion; and a trough cut through the monolithic shaft assembly, wherein the trough provides clearance through which a hammer protrusion passes when the ambidextrous thumb safety assembly is disengaged.

2. The ambidextrous thumb safety assembly of claim 1 wherein the monolithic shaft assembly is a portion of one of the first and second lever assemblies.

3. The ambidextrous thumb safety assembly of claim 1 wherein the monolithic shaft assembly is configured to releasably engage one of the first and second lever assemblies.

4. The ambidextrous thumb safety assembly of claim 1 wherein the monolithic shaft assembly includes a protrusion and at least one of the first and second lever assemblies includes a recess configured to receive the protrusion.

5. The ambidextrous thumb safety assembly of claim 4 wherein the protrusion is a bowtie-shaped protrusion and the recess is a bowtie-shaped recess configured to receive the bowtie-shaped protrusion.

6. The ambidextrous thumb safety assembly of claim 1 wherein first and second support portions are positioned on opposite sides of the control portion.

7. The ambidextrous thumb safety assembly of claim 1 wherein the trigger mechanism of the firearm includes a hammer assembly and the control portion of the monolithic shaft assembly is configured to selectively prohibit operation of the hammer assembly.

8. The ambidextrous thumb safety assembly of claim 7 wherein the control portion of the monolithic shaft assembly is configured to selectively lock the hammer assembly in a cocked position.

9. The ambidextrous thumb safety assembly of claim 7 wherein the control portion of the monolithic shaft assembly is configured to selectively lock the hammer assembly in an uncocked position.

10. The ambidextrous thumb safety assembly of claim 7 wherein the trigger mechanism of the firearm includes a linkage assembly for coupling a trigger assembly to the hammer assembly included within the firearm.

11. The ambidextrous thumb safety assembly of claim 10 wherein the linkage assembly includes a trigger bar and a sear assembly.

12. The ambidextrous thumb safety assembly of claim 11 wherein the control portion of the monolithic shaft assembly is configured to selectively prohibit operation of the sear assembly.

13. The ambidextrous thumb safety assembly of claim 1 wherein the firearm is a handgun.

14. A firearm comprising:

a trigger mechanism including:

a hammer assembly, and a linkage assembly for coupling a trigger assembly to the hammer assembly; and an ambidextrous thumb safety assembly including:

a first lever assembly for positioning on a first side of the firearm;

a second lever assembly for positioning on a second side of the firearm; and a monolithic shaft assembly for coupling the first lever assembly and the second lever assembly, the monolithic shaft assembly including:

a first support portion configured to rotatably engage a first portion of a frame of the firearm, a second support portion configured to rotatably engage a second portion of the frame of the firearm, and a control portion configured to selectively prohibit operation of the trigger mechanism of the firearm wherein the first support portion and the second support portion are positioned on opposite sides of the control portion;

a trough, the trough cut through the monolithic shaft assembly, wherein the trough provides clearance through which a hammer protrusion passes when the ambidextrous thumb safety assembly is disengaged.

15. The ambidextrous thumb safety assembly of claim 14 wherein the monolithic shaft assembly is a portion of one of the first and second lever assemblies.

16. The ambidextrous thumb safety assembly of claim 14 wherein the control portion of the monolithic shaft assembly is configured to selectively prohibit operation of the hammer assembly.

17. The ambidextrous thumb safety assembly of claim 16 wherein the control portion of the monolithic shaft assembly is configured to selectively lock the hammer assembly in a cocked position.

18. The ambidextrous thumb safety assembly of claim 16 wherein the control portion of the monolithic shaft assembly is configured to selectively lock the hammer assembly in an uncocked position.

19. An ambidextrous thumb safety assembly configured for use in a firearm comprising:

a first lever assembly for positioning on a first side of the firearm;

a second lever assembly for positioning on a second side of the firearm; and a monolithic shaft assembly for coupling the first lever assembly and the second lever assembly, the monolithic shaft assembly including:

a first support portion configured to rotatably engage a first portion of a frame of the firearm, a second support portion configured to rotatably engage a second portion of the frame of the firearm, and a control portion configured to selectively prohibit operation of a hammer assembly of the firearm, wherein the first support portion and the second support portion are positioned on opposite sides of the control portion;

a trough, the trough cut through the monolithic shaft assembly, wherein the trough provides clearance through which a hammer protrusion passes when the ambidextrous thumb safety assembly is disengaged.

20. The ambidextrous thumb safety assembly of claim 19 wherein the monolithic shaft assembly is a portion of one of the first and second lever assemblies.

21. The ambidextrous thumb safety assembly of claim 19 wherein the trigger mechanism of the firearm includes a hammer assembly and the control portion of the monolithic shaft assembly is configured to selectively prohibit operation of the hammer assembly.

22. The ambidextrous thumb safety assembly of claim 21 wherein the control portion of the monolithic shaft assembly is configured to selectively lock the hammer assembly in a cocked position.

23. The ambidextrous thumb safety assembly of claim 21 wherein the control portion of the monolithic shaft assembly is configured to selectively lock the hammer assembly in an uncocked position.

* * * * *